US006979960B2

(12) United States Patent
Okawa et al.

(10) Patent No.: US 6,979,960 B2
(45) Date of Patent: Dec. 27, 2005

(54) CIRCUIT FOR DRIVING LIGHT SOURCE, PROJECTOR, METHOD FOR CONTROLLING LIGHTING OF LIGHT SOURCE, AND COMPUTER READABLE PROGRAM FOR EXECUTING THE SAME

(75) Inventors: Kazuo Okawa, Matsumoto (JP); Tomiyoshi Ushiyama, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 10/715,504

(22) Filed: Nov. 19, 2003

(65) Prior Publication Data

US 2004/0136134 A1 Jul. 15, 2004

(30) Foreign Application Priority Data

Dec. 25, 2002 (JP) ..... 2002-374286

(51) Int. Cl.[7] ..... G05F 1/00
(52) U.S. Cl. ..... 315/291; 315/224; 315/307; 353/85
(58) Field of Search ..... 315/209 R, 224–226, 315/291, 307; 353/30, 34, 85

(56) References Cited

U.S. PATENT DOCUMENTS 5,811,942 A * 9/1998 Pedretti ..... 315/312
6,409,350 B1 * 6/2002 Kakimoto et al. ..... 353/85
6,543,900 B2 * 4/2003 Noji et al. ..... 353/94
6,634,757 B2 * 10/2003 Asakawa ..... 353/85
6,650,069 B2 * 11/2003 Kito ..... 315/308

FOREIGN PATENT DOCUMENTS

| | | |
|---|---|---|
| JP | B2 2506966 | 4/1996 |
| JP | A 8-304739 | 11/1996 |
| JP | 09-017217 | 1/1997 |
| JP | A 9-274886 | 10/1997 |
| JP | A 11-297268 | 10/1999 |
| JP | 2003-295320 A | 10/2003 |

* cited by examiner

*Primary Examiner*—Thuy Vinh Tran
(74) *Attorney, Agent, or Firm*—Oliff & Berridge, PLC

(57) ABSTRACT

The invention provides a circuit to drive a light source capable of lengthening the life span of the light source and of coping with both a rated power mode and a power saving mode. A circuit to drive a light source includes a control device to drive the light source, which is composed of a discharge tube, and to switch the light source to a plurality of lighting modes including a rated power mode and a power saving mode. The control device includes a lighting mode setting unit to set the lighting mode to one of the plurality of lighting modes, and a rated power supplying unit to supply a rated power to the light source at the lighting starting time of the light source until a halogen cycle of the discharge tube is stabilized. The control device switches the light source to the lighting mode set by the lighting mode setting unit after the halogen cycle of the discharge tube is stabilized.

8 Claims, 16 Drawing Sheets

CIRCUIT FOR DRIVING LIGHT SOURCE, PROJECTOR, METHOD FOR CONTROLLING LIGHTING OF LIGHT SOURCE, AND COMPUTER READABLE PROGRAM FOR EXECUTING THE SAME

BACKGROUND OF THE INVENTION

1. Field of Invention

The present invention relates to a circuit to drive a light source which includes a control device to drive the light source, which is composed of a discharge tube, and to switch the light source to a plurality of lighting modes including a rated power mode and a power saving mode. The invention also relates to a projector including the same; a method of controlling a light source which is executed in the circuit to drive the light source including the control device to drive the light source, which is composed of the discharge tube, and to switch the light source to the plurality of lighting modes including the rated power mode and the power saving mode; and to a program which executes the method of controlling the light source using the control device.

2. Description of Related Art

The related art includes projectors that can be used to modulate beams emitted from a light source according to image information, and to enlarge and project the modulated beams. The related art also includes projectors that can been used, for example, when a company makes presentations through a personal computer or a home user watches a movie.

In the company presentation, the light source needs to be lighted at high brightness, in order that every viewer can easily view the projected image. On the other hand, because the home user sees the image at a relatively short distance, the light source does not need to be lighted at high brightness.

Accordingly, a related art projector uses plural kinds of lighting modes including a rated power mode for presentations and a power saving mode for home theaters.

On the other hand, a related art high-pressure mercury lamp or related art metal halide lamp in which halogen gas is charged in a discharge tube can be employed as the light source for the projector to stably emit light at high brightness and stability (for example, see Japanese Unexamined Patent Application Publication No. 11-297268, and Japanese Unexamined Patent Application Publication No. 9-274886).

SUMMARY OF THE INVENTION

However, referring to Japanese Unexamined Patent Application Publication No. 11-297268, and Japanese Unexamined Patent Application Publication No. 9-274886, when a light source is lighted in a power saving mode, the light source is initially lighted with a power lower than the rated power. Thus, electrodes of the light source are insufficiently warmed, and an appropriate halogen cycle is not obtained. Accordingly, the life span of the light source may be reduced due to the blacking of a discharge tube.

The present invention provides a circuit to drive a light source capable of coping with a rated power mode and a power saving mode and of lengthening the life span of the light source, a projector, a method of controlling the lighting of a light source, and a computer readable program for executing the same.

A circuit to drive a light source of the present invention includes a control device to drive the light source, which is composed of a discharge tube, and to switch the light source to a plurality of lighting modes including a rated power mode and a power saving mode. The control device includes a lighting mode setting unit to set the lighting mode to one of the plurality of lighting modes, and a rated power supplying unit to supply the rated power to the light source at the lighting time of the light source until a halogen cycle of the discharge tube is stabilized. Furthermore, the control device switches the light source to the lighting mode set by the lighting mode setting unit after the halogen cycle of the discharge tube is stabilized.

Herein, discharging type illuminates, such as metal halide lamps, high-pressure mercury lamps, and halogen lamps, for example, can be used as a light source.

In addition, the control device can include a microcomputer mounted on the circuit to drive the light source. About 4 bits of microcomputer is preferable to achieve the above functions.

According to the present invention, since the light source is lighted with a rated power for a predetermined time by the rated power supplying unit at the lighting time, electrodes of the discharge tube are sufficiently heated to obtain an appropriate halogen cycle. Thus, even if the light source is switched to the power saving mode, an inside temperature is maintained by the illumination of the discharge tube to maintain the halogen cycle. Accordingly, the present invention efficiently deals with the power saving mode and the rated power mode, and thus increases the life span of the light source.

Preferably, the switching between the plurality of lighting modes is performed for one or more seconds.

The following exemplary methods of switching the lighting modes can be used.

(1) The switching between the lighting modes is performed by gradually changing the power.

(2) The switching between the lighting modes is performed by linearly changing the power in switching.

(3) The switching between the lighting modes is performed by changing the rate of change of power in switching with respect to time in curvilinear fashion.

In accordance with the present invention, since the switching between the lighting modes is performed for one or more seconds, the flicker of the screen is reduced or prevented when the light source is used for the projector.

That is, if the switching between lighting modes is performed in a moment, the temperature distribution of the electrodes in the discharge tube is changed to vary discharge points, and thus arc discharge is generated which causes the flicker of the screen. According to the present invention, since the switching between the lighting modes is gradually performed for one second, prominences and depressions are not formed on the discharge surfaces of the electrodes, and the flicker of the screen is reduced or prevented.

Furthermore, since variations of power are digitalized by the switching Method (1), the switching can be efficiently controlled by a microcomputer.

Moreover, the variations of power continuously and smoothly occur by the switching Methods (2) and (3).

Preferably, the circuit to drive the light source includes an inverter bridge to convert input direct current into alternating current.

A transistor or a field effect transistor can be used as a circuit device constituting the inverter bridge.

According to the present invention, an alternating current driving type light source can be employed by the addition of the inverter bridge. Accordingly, the alternating current light source is illuminated lighter than the direct current light source.

A projector of the present invention, which modulates beams emitted from a light source according to image information in order to form an optical image, and enlarges and projects the optical image, includes any of the circuits to drive the light source as described above.

As described above, according to the present invention, it is possible to provide the projector capable of efficiently dealing with the rated mode and power saving mode of the light source and of lengthening the life span of the light source.

In addition, since the light source is lighted in the power saving mode, an increase of the inside temperature in the projector is restricted. Therefore, the number of revolutions of the cooling fan in the projector can be reduced during the operation, thereby achieving a silent or substantially silent projector.

A method of controlling the lighting of a light source according to the present invention is executed in a circuit to drive the light source including a control device to drive the light source, which is composed of a discharge tube, and to switch the light source into a plurality of lighting modes including a rated power mode and a power saving mode. The control device performs: setting the lighting mode to one of the plurality of lighting modes; supplying the rated power to the light source at the lighting time of the light source until a halogen cycle of the discharge tube is stabilized; and switching the light source to the lighting mode set in the setting of the lighting mode after the halogen cycle of the discharge tube is stabilized.

A computer readable program of the present invention executes each of the steps by the control device of the circuit to drive the light source.

The same operations and effects as the aforementioned ones are also achieved by the above exemplary embodiments.

DETAILED DESCRIPTION OF PREFERRED EMBODIMENTS

An exemplary embodiment of the present invention is explained below with reference to the accompanying drawings.

(1) External Structure

Figure 1:
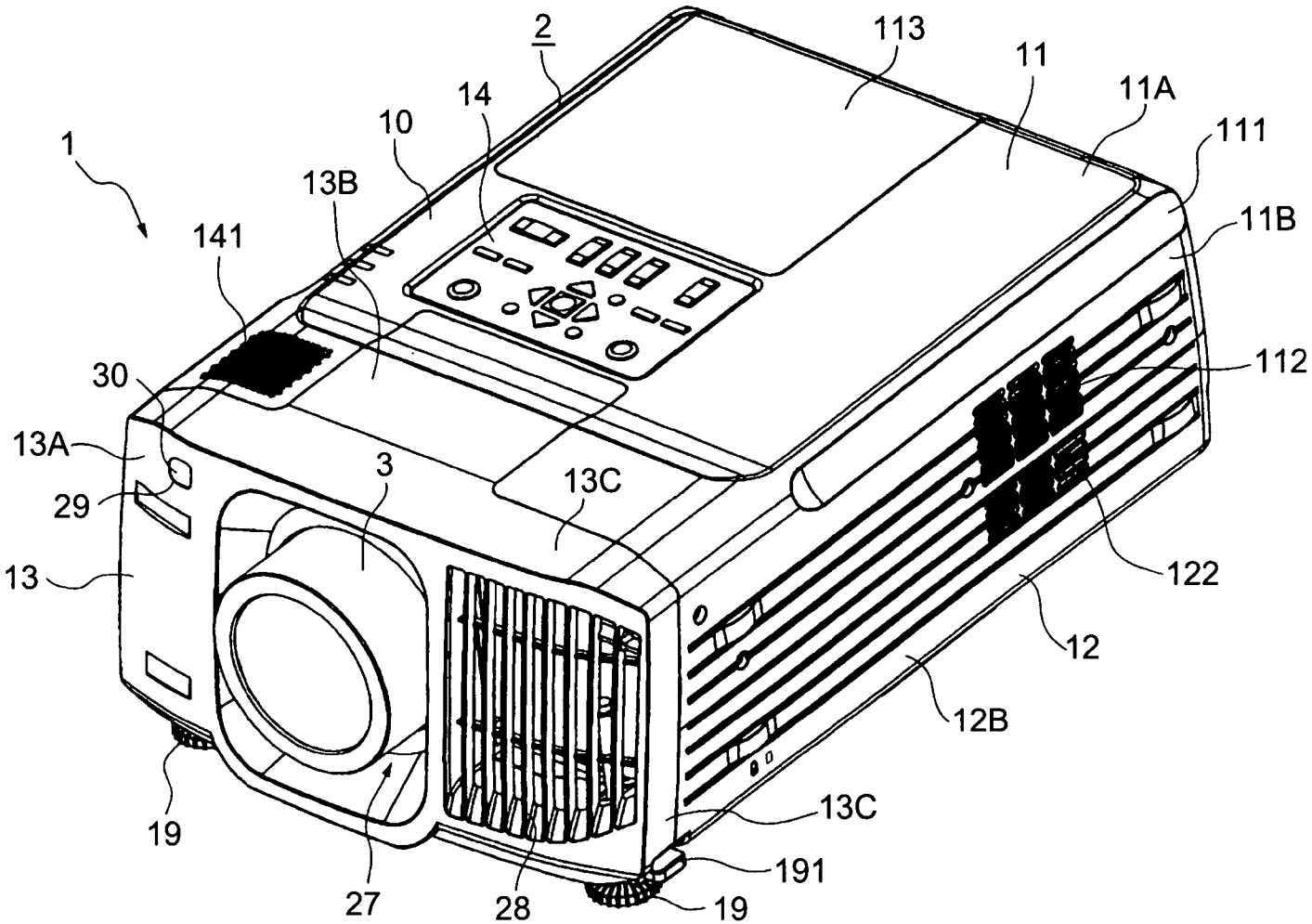
FIG. 1 is a schematic perspective view illustrating the appearance of a projector in accordance with an exemplary embodiment of the present invention.
Figure 2:
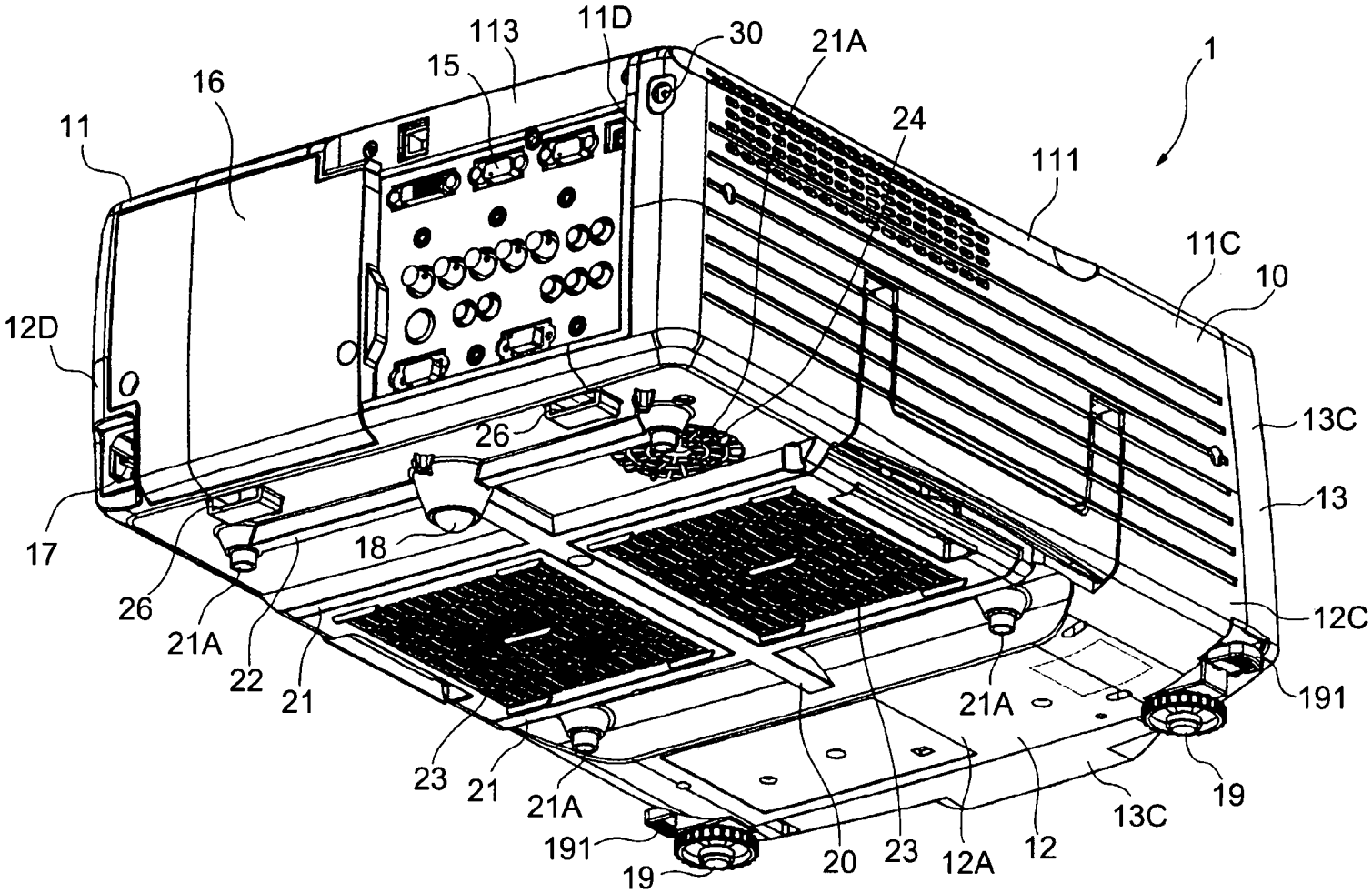
FIG. 2 is a schematic perspective view illustrating the appearance of the projector in accordance with the exemplary embodiment.

FIGS. 1 and 2 illustrate a projector 1 in accordance with one exemplary embodiment of the present invention. FIG. 1 is a perspective view as viewed from the top front side, and FIG. 2 is a perspective view as viewed from the bottom rear side.

The projector 1 is an optical apparatus to modulate beams emitted from a light source according to image information and to enlarge and protect the image on the screen. The projector 1 includes an armored case 2 to encase an apparatus main body including an optical unit (which is discussed below) and a projection lens 3 which is exposed through the armored case 2. The projector 1 is installed in a large-scaled store or public spaces to display the projected image on the screen, so that a plurality of viewers can use the image information.

The projection lens 3 performs a function of a projection optical system which projects the enlarged optical image that is obtained by modulating the beams emitted from the light source according to the image information using a liquid crystal panel of an optical modulating apparatus which is discussed below, and includes a plurality of lenses in a cylindrical hard packing.

The armored case 2 is formed in a rectangular parallelepiped shape in which a length in the projection direction is longer than a width in the orthogonal direction thereof. The armored case 2 includes a face body to cover the apparatus main body and a frame body to support case strength.

The face body 10 includes an upper case 11 to cover the upper side of the apparatus main body, a lower case 12 to cover the lower side of the apparatus main body, and a front case 13 to cover the front side of the apparatus main body. Each of the cases 11 to 13 is a single synthetic resin product molded by injection molding.

The upper case 11 includes a case upper side unit 11A, which covers the upper side of the apparatus main body, case side units 11B and 11C, which are approximately vertical to both ends of the case surface unit 11A in the width direction, and a case rear surface unit 11D, which is approximately vertical to the rear end of the case upper side unit 11A.

Concave parts 111, which are surface-processed to concave from the center to rear end of the projector 1 in the projection direction, are formed on the ridgelines where the case surface unit 11A and case side units 11B and 11C of the upper case 11 intersect each other. When two projectors 1 are stacked, a pipe-shaped supporting member to couple the two projectors 1 is inserted into the concave parts 111.

In addition, slit-shaped openings 112 to inhale cool air are formed in the case side unit 11B.

An operation panel 14 to start and control the projector 1 is provided in the substantial center of the case upper side unit 11A. The operation panel 14 has a plurality of switches including a starting switch and an image/voice control switch. When the image is projected by the projector 1, the control switch of the operation panel 14 is used to control image quality and volume.

Furthermore, a plurality of holes 141 is formed at the front side of the case upper side unit 11A in the projection direction. A voice output speaker, which is discussed below, is provided inside the plurality of holes 141.

The operation panel 14 and the speaker are electrically connected to a control substrate constituting the apparatus main body (which is discussed below), and control signals from the operation panel 14 are processed in the control substrate.

The case rear surface unit 11D is formed in a frame shape with its entire surface almost opened. A connector group 15 to receive image signals is exposed through the opened side. An opening part to receive the light source apparatus in the vicinity of the connector group 15 is generally covered by a lid member to receive the light source apparatus 16. In addition, the connector group 15 is electrically connected to the control substrate (which is discussed below), so image signals inputted through the connector group 15 are processed by the control substrate.

A lid member 113, which is removable from the upper case 11, is mounted at the rear end of the case upper side unit 11A and the top end of the case rear surface unit 11D. An expanded substrate, such as a LAN board, can be inserted into the lid member 113, which is discussed in detail below.

The lower case 12 is nearly symmetrical to the upper case 11 with respect to the interface to the upper case 11 as the center, and includes a case bottom side unit 12A, case side units 12B and 12C, and a case rear side unit 12D.

The top ends of the case side units 12B and 12C and the case rear side unit 12D are interfaced with the lower ends of the case side units 11B and 11C and the case rear surface unit 11D of the upper case 11. Similarly to the case rear surface unit lI D of the upper case 11, the case rear side unit 12D has its entire surface almost opened. Therefore, the connector group 15 is exposed from the opened side after interfacing, and a lid member 16 is mounted over the two opening parts.

Furthermore, an opening part is formed at an edge of the case rear side unit 12D, so an inlet connector 17 can be exposed through the opening part. Moreover, in the case side unit 12B, an opening part 122 is formed at a position corresponding to the opening unit 112 of the case side unit 11B of the upper case 11.

In the case bottom side unit 12A, a fixed leg unit 18 is provided at the center of the rear end of the projector 1, and adjustable leg units 19 are provided at the width direction ends of the front end of the projector 1.

The adjustable leg unit 19 includes a shaft-shaped member that is retractable and externally protruded from the case bottom side unit 12A in the bottom direction. The shaft member itself is encased in the armored case 2. The protrusions of the adjustable leg units 19 from the case bottom side unit 12A can be adjusted by control buttons 191 which are provided at the both sides of the projector 1.

Accordingly, the up and down positions of the projected image from the projector 1 can be adjusted, so the image can be projected to the desired position.

A convex rib shape unit 20, which is extended in the projection direction, and a plurality of rib shape units 21 and 22, which are extended in the width direction of the projector 1 to be orthogonal to the rib shape unit 20, are formed in the substantial center of the case bottom side unit 12A. An inhalation opening part to inhale external cooled air is formed between the two rib shape units 21 at the center of the case bottom side unit 12A, and is covered with a filter 23 (which is discussed in detail below). An inhalation opening part 24 to inhale cooled air is also formed at the rear end of the inhalation opening part covered with the filter 23, but it is not covered with a filter.

Four screw holes 21A are formed at the ends of the rib shape units 21 and 22, which are extended in the width direction of the projector 1. An iron ornament to hang the projector 1 on the ceiling is provided in the screw hole 21A.

Furthermore, interface units 26 are formed on the edge of the rear side of the case bottom side unit 12A. A cover member to cover the connector group 15 to protect from dust can be attached in the interface unit 26.

The front case 13 includes a front surface unit 13A and an upper side unit 13B. A rib 13C, which is extended outside the surface of the front surface unit 13A, is formed on the outer circumference of the front surface unit 13A, and interfaces with the ends of the upper case 11 and the lower case 12 in the projection direction.

The front surface unit 13A inclines towards the rear end of the apparatus, from the case bottom side unit 12A of the lower case 12 to the case upper side unit 11A of the upper case 11, and thus becomes distant from the projected surface. Accordingly, when the projector 1 is suspended from the ceiling, it is possible to reduce or prevent dust from laying on the front surface unit 13A since the front surface unit 13A of the front case 13 faces the bottom surface. Accordingly, even if the projector 1 is suspended from the ceiling, it is possible to easily maintain the projector 1 similarly to an ordinary installation state.

An opening part 27 is formed in the substantial center of the front surface unit 13A. The projection lens 3 is exposed through the opening part 27.

A slit-shaped opening part 28 is formed adjacently to the opening part 27, so air, which cools the apparatus main body of the projector 1, can be exhausted through the opening part 28.

Furthermore, a hole 29 is formed at an edge of the front surface unit 13A. A light receiving unit 30 to receive control signals from a remote controller (not shown) is provided at the hole 29.

In this exemplary embodiment, the light receiving unit 30 is also provided on the rear surface of the projector 1, specifically at an edge of the case rear surface unit 11D of the upper case 11 as shown in FIG. 2. Therefore, when the remote controller is used, the control signals from the remote controller can be input into both the front and rear directions of the apparatus.

The upper side unit 13B is extended to the substantial center of the case upper side unit 11A of the upper case 11 and to the base end of the projection lens 3 (which is not illustrated concretely). Accordingly, when changing the projection lens 3, the projection lens 3 can be easily replaced by only removing the front case 13. That is, when the front case 13 is separated from the upper case 11 and the lower case 12, the upper side unit 13B is separated from the projector 1 to have an opening, and the coupling part of the base end of the projection lens 3 is exposed.

(2) Internal Structure

Figure 3:
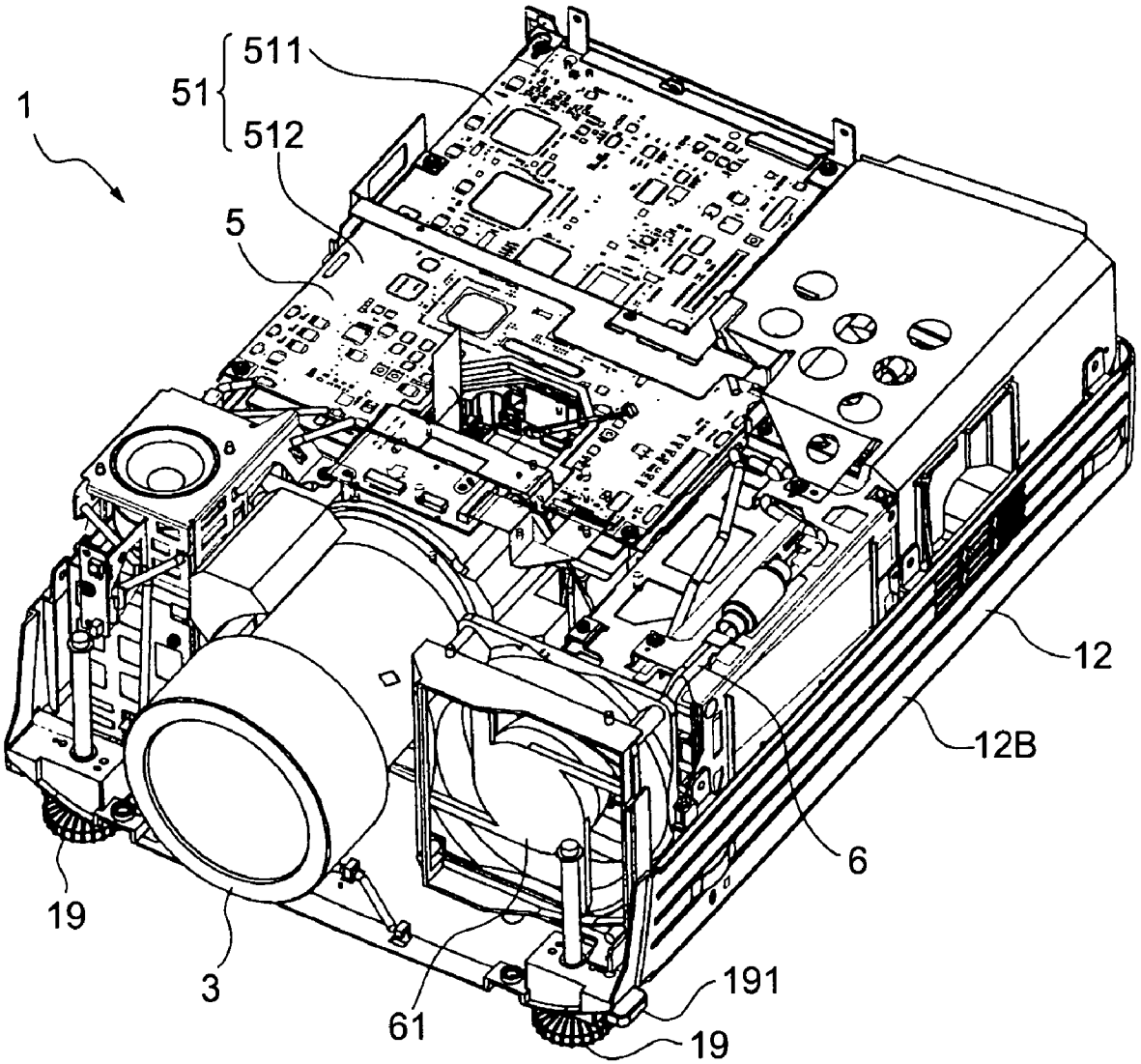
FIG. 3 is a schematic perspective view illustrating the inside of the projector in accordance with the exemplary embodiment.
Figure 4:
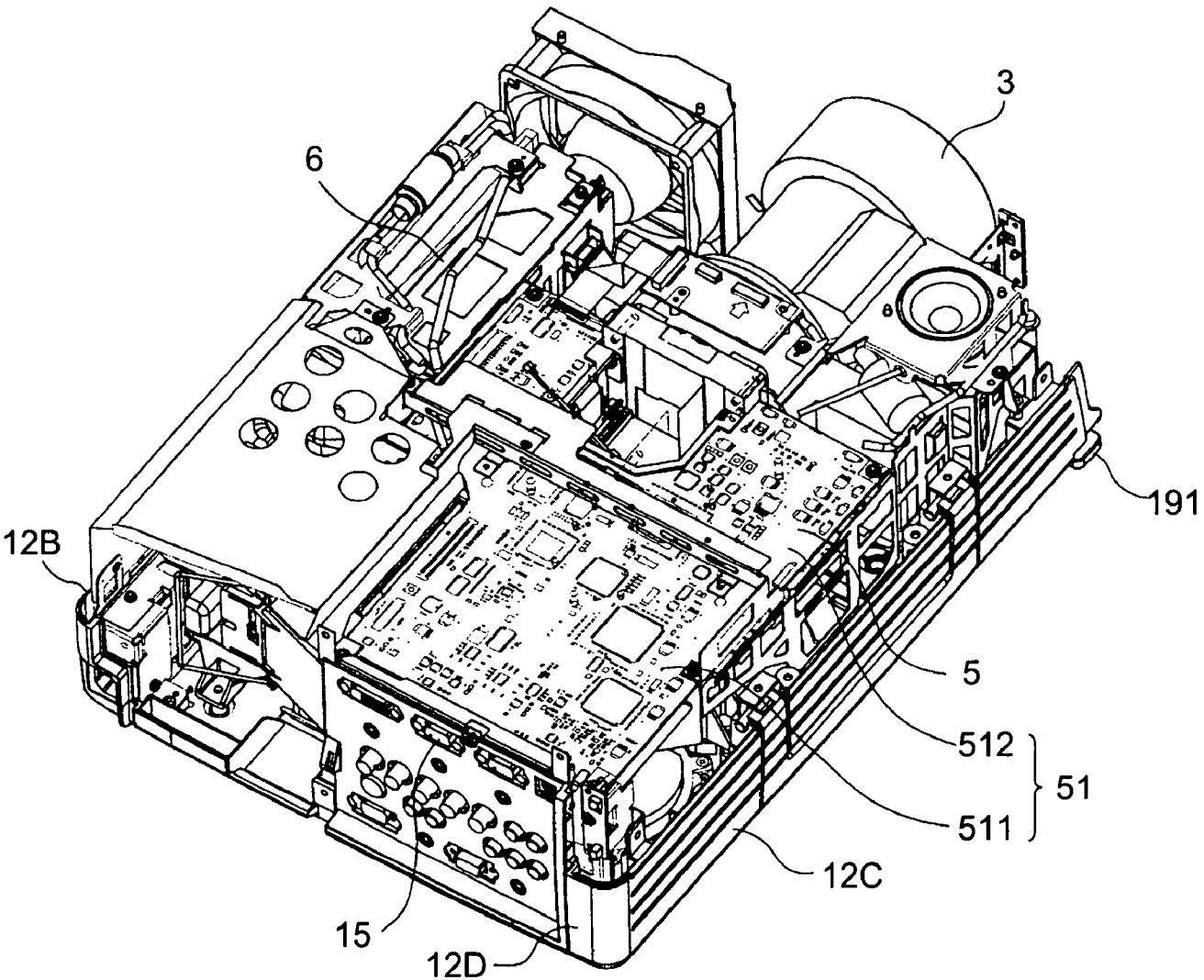
FIG. 4 is a schematic perspective view illustrating the inside of the projector in accordance with the exemplary embodiment.
Figure 5:
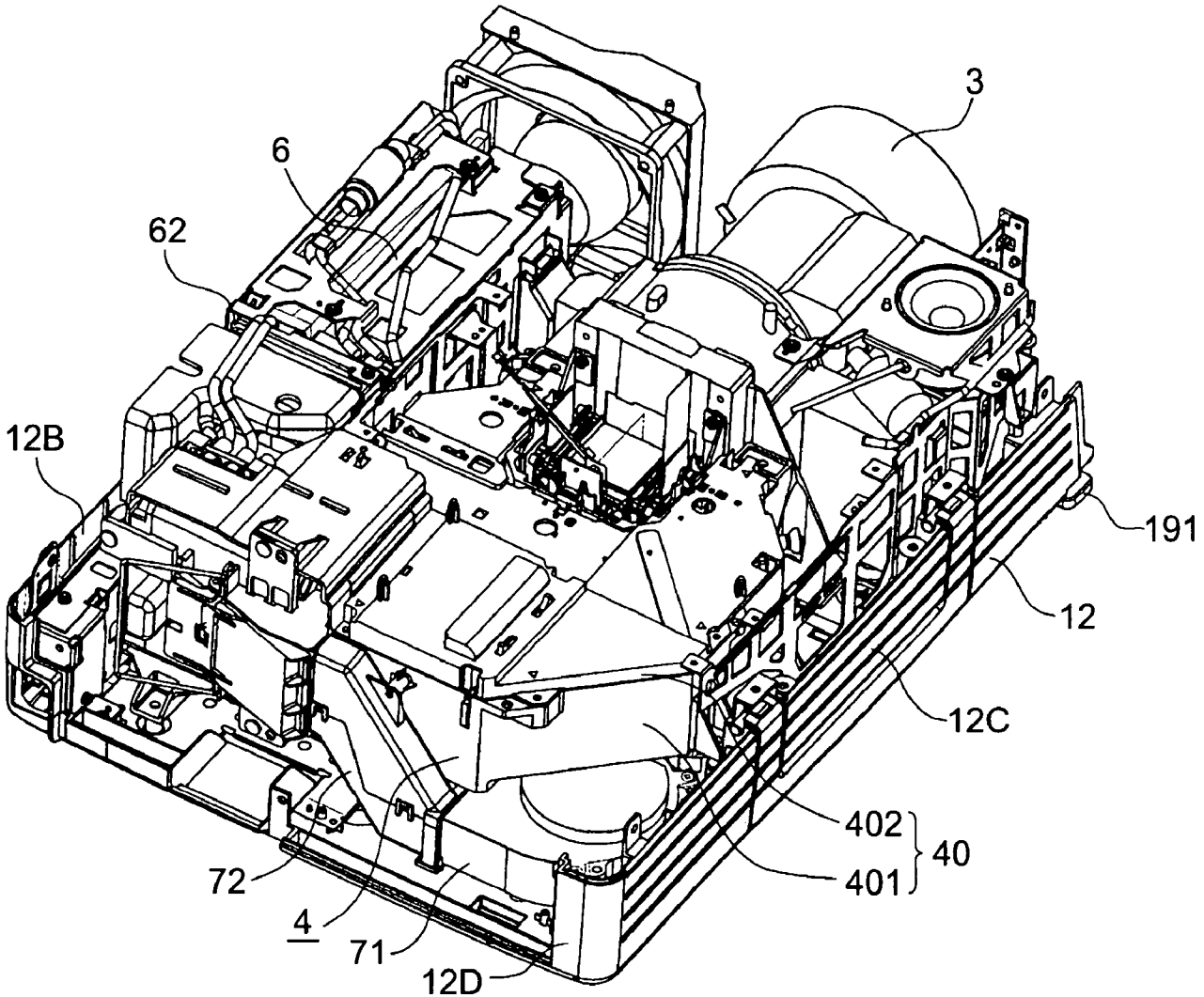
FIG. 5 is a schematic perspective view illustrating the inside of the projector in accordance with the exemplary embodiment.

As illustrated in FIGS. 3 to 5, the apparatus main body of the projector 1 is encased in the armored case 2. The apparatus main body includes an optical unit 4, a control unit 5, and a power block 6.

(2-1) Structure of Optical Unit 4

The optical unit 4, which is an optical engine, modulates beams emitted from the light source apparatus according to image information to form an optical image, and projects the image on the screen through the projection lens 3. As shown in FIG. 5, the optical unit 4 is formed by assembling the light source apparatus and various optical components into an optical component case called a light guide 40.

The light guide 40 includes a lower light guide 401 and an upper light guide 402. Each of them is a synthetic resin product molded by injection molding.

Figure 6:
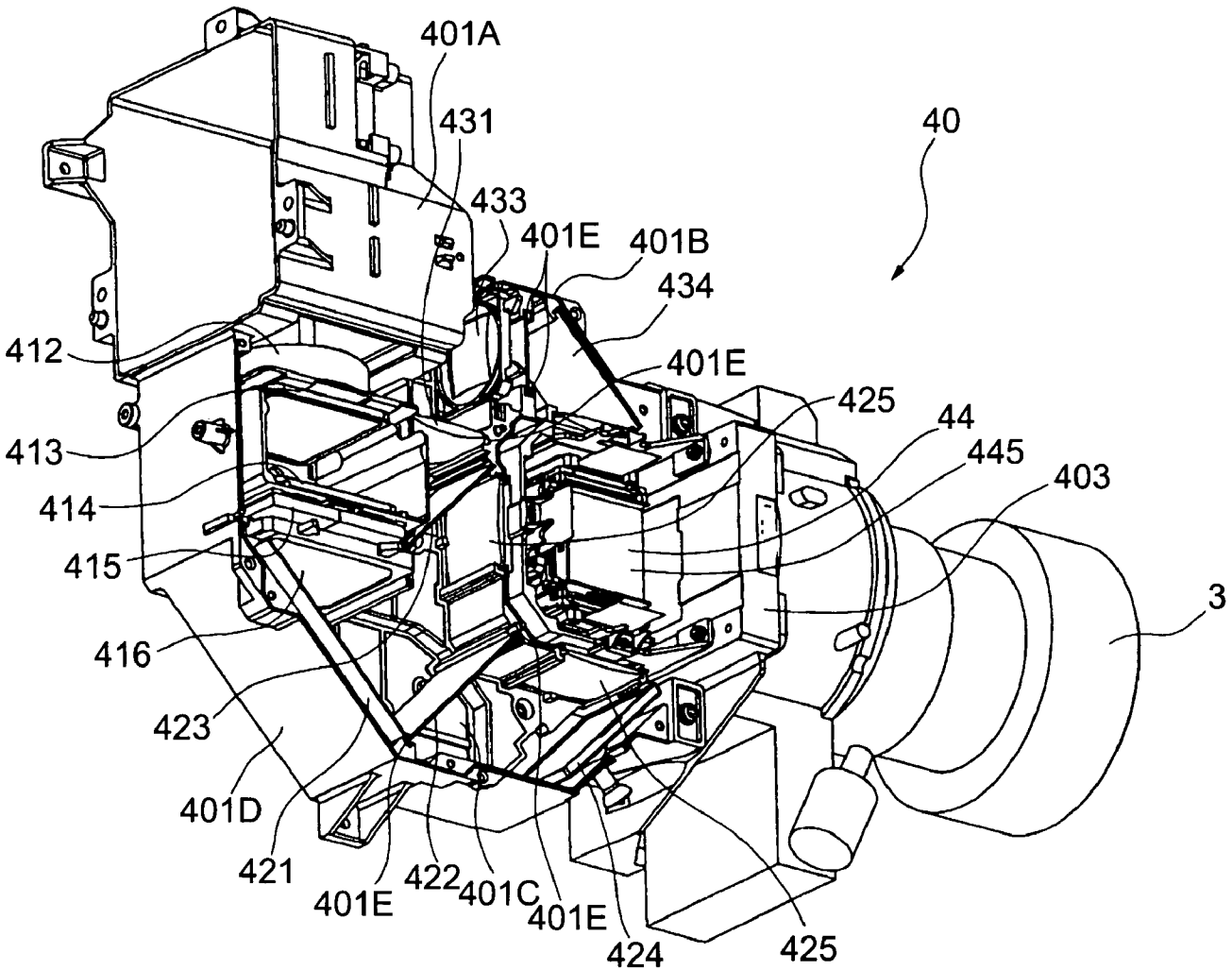
FIG. 6 is a schematic perspective view illustrating a structure of a light guide for receiving an optical unit in accordance with the exemplary embodiment.

As illustrated in FIG. 6, the lower light guide 401 includes a light source receiving unit 401A to receive the light source apparatus (which is discussed below), and a component receiving unit 401B to receive optical components. The component receiving unit 401B is in the form of a vessel that includes a bottom surface unit 401C and a sidewall unit 401D and has its top end opened. A plurality of recess units 401E is provided in the sidewall unit 401D. Various optical components constituting the optical unit 4 are mounted in the recess units 401E and thus are precisely aligned on the illumination optical axis set in the light guide 40. The upper light guide 402 is formed in a flat shape corresponding to the lower light guide 401 and is a cover-shaped member covering the upper side of the lower light guide 401.

In addition, an L-shaped metal head body 403 is provided at the beam exit end of the lower light guide 401. An optical apparatus 44 (which is discussed below) is mounted at the horizontal side of the L-shaped head body 403, and the base end of the projection lens 3 adheres to the vertical side thereof.

Figure 7:
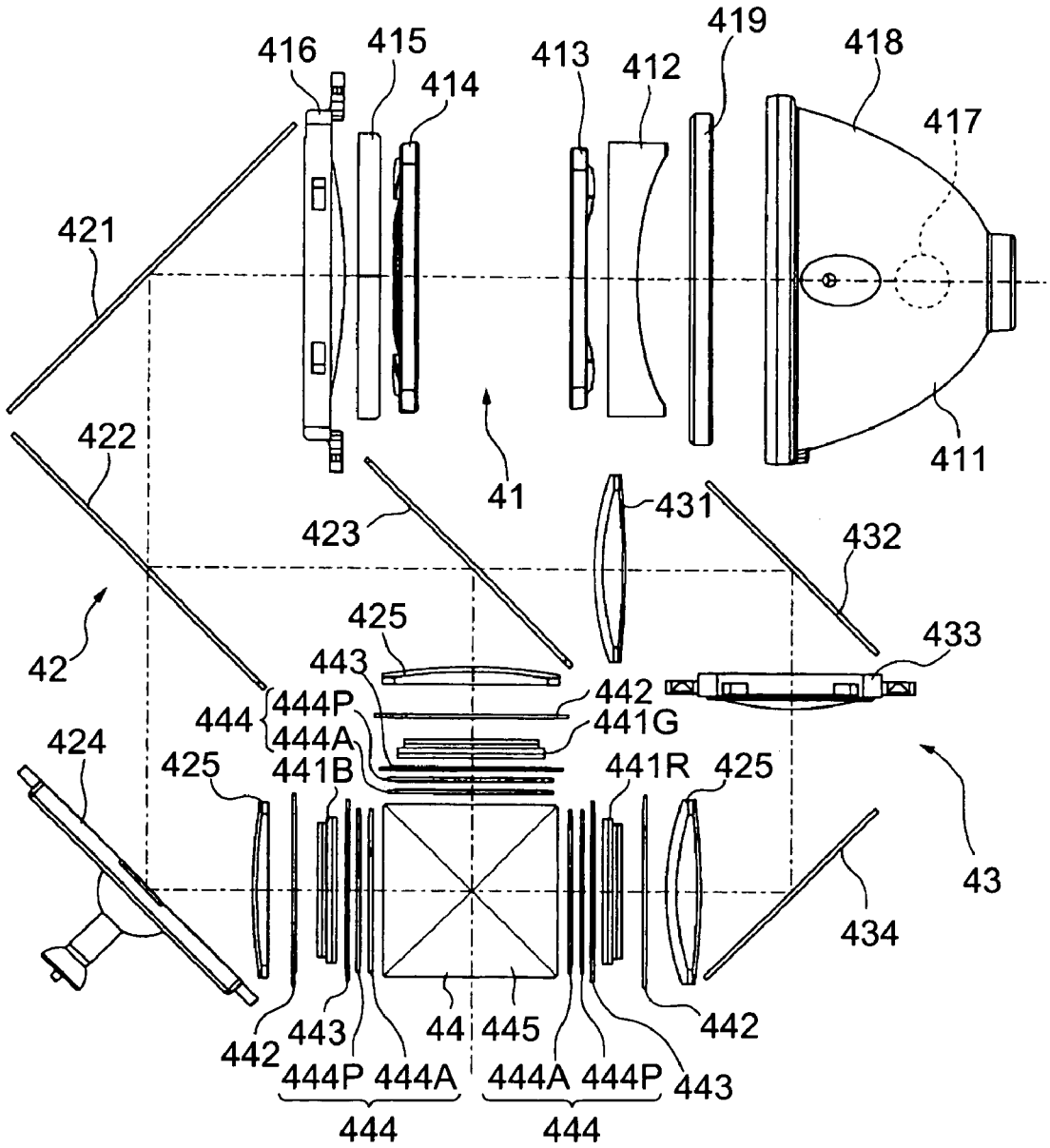
FIG. 7 is a schematic illustrating a structure of an optical unit in accordance with the exemplary embodiment.

As shown in FIG. 7, the light guide 40 is divided to an integrator illumination optical system 41, a color separation optical system 42, a relay optical system 43, and an optical apparatus 44 incorporating an optical modulating optical system with a color composition optical system in view of functions. The optical unit 4 of this exemplary embodiment is used in a three-plate type projector and is a spatial color separation type optical unit, which separates white beam from the optical source into three-color beams within the light guide 40.

The integrator illumination optical system 41 equalizes the intensity of the illumination of the beams from the light source on the orthogonal surface to the illumination optical axis, and includes a light source apparatus 411, a collimating concave lens 412, a first lens array 413, a second lens array 414, a polarization converting device 415, and a superposing lens 416.

The light source apparatus 411 includes a light source lamp 417, which is a radiation light source, a reflector 418, and a front glass 419, which covers the beam exit surface of the reflector 418. The light source apparatus 411 reflects the radiated beams from the light source lamp 417 on the collimating concave lens 412 and the reflector 418 to collimate the beams and then emit the beams to the outside. In this exemplary embodiment, a high-pressure mercury lamp is used as the light source lamp 417. However, a metal halide lamp or a halogen lamp can also be used. In addition, according to this exemplary embodiment, the collimating concave lens 412 is aligned on the beam exit surface of the reflector 418, which is an elliptic mirror. A parabolic mirror can also be used as the reflector 418.

A plurality of small lenses having rectangular outlines as viewed from the illumination optical axis direction is arranged in a matrix shape on the first lens array 413. Each of the small lenses divides the beams from the light source lamp 417 into partial beams and emits them in the illumination optical axis direction. The shapes of the small lenses are almost identical to the shapes of the image formation areas of liquid crystal panels 441R, 441G, and 441B (which is discussed below). For example, when aspect ratios of the image formation areas of the liquid crystal panels 441R, 441G, and 441B are 4 to 3, aspect ratios of the small lenses are also set to at 4 to 3.

The second lens array 414 has almost the identical structure to the first lens array 413. That is, small lenses are aligned in a matrix shape. The second lens array 414 forms images of each small lens in the first lens array 413 on the liquid crystal panels 441R, 441G, and 441B together with the superposing lens 416.

The polarization converting device 415 converts light from the second lens array 414 into one kind of polarized light, thereby enhancing the efficiency of light in the optical apparatus 44.

In detail, each one of the partial beams that are converted into the one kind of polarized light by the polarization converting device 415 eventually overlaps on the liquid crystal panels 441R, 441G, and 441B of the optical apparatus 44 by the superposing lens 416. In the projector using the liquid crystal panels 441R, 441G, and 441B to modulate the polarized light, only one kind of polarized light is used. Thus, approximately half of the beams from the light source lamp 417 emitting random polarized light are not used. Accordingly, by using the polarization converting device 415, it is possible to convert the entire beams from the light source lamp 417 into one kind of polarized light, thereby enhancing the utilizing efficiency of light in the optical apparatus 44. Such a polarization converting device 415 is disclosed in Japanese Unexamined Patent Application Publication No. 8-304739.

The color separation optical system 42 includes a reflecting mirror 421 to curve the beams from the integrator illumination optical system 41, two dichroic mirrors 422 and 423, and a reflecting mirror 424. The color separation optical system 42 separates a plurality of partial beams from the integrator illumination optical system 41 into R, G, and B color beams using the dichroic mirrors 422 and 423. In this exemplary embodiment, the position of the reflecting mirror 424 to the lower light guide 401 can be adjusted.

The relay optical system 43, which includes an incident side lens 431, a relay lens 433, and reflecting mirrors 432 and 434, transmits the red light separated by the color separation optical system 42 to the liquid crystal panel 441R.

The dichroic mirror 422 of the color separation optical system 42 reflects red light components and green light components of the beams from the integrator illumination optical system 41 and transmits blue light components thereof. The blue light transmitted through the dichroic mirror 422 is reflected from the reflecting mirror 424 and is transmitted to the liquid crystal panel for blue light 441B through a field lens 425. The field lens 425 converts each of the partial beams from the second lens array 414 into beams that are parallel to the center axis (a main ray of light) thereof. Field lenses 425, which are provided at the light incident sides of the other liquid crystal panels 441G and 441R, are operated in the same manner.

In the case of red and green light reflected from the dichroic mirror 422, the green light is reflected from the dichroic mirror 423 and then transmitted to the liquid crystal panel for green light 441G through the field lens 425. The red light is transmitted to the relay optical system 43 through the dichroic mirror 423 and then transmitted to the liquid crystal panel for red light 441R through the field lens 425.

Because the optical path of red light is longer than that of other color light, the relay optical system 43 is used to reduce or prevent the reduction of the utilizing efficiency of light due to the diffusion of light. That is, the partial beams incident to the incident side lens 431 are directly transmitted to the field lens 425. Furthermore, the relay optical system 43 is formed to transmit red light, but may be formed to transmit the other light, for example, blue light.

The optical apparatus 44 forms a color image by modulating the incident beams according to the image information, and it includes three incident side polarizing plates 442, to which each color light separated by the color separation optical system 42 is transmitted, liquid crystal panels 441R, 441G, and 441B, which are optical modulation devices arranged at the rear sides of the respective incident side polarizing plates 442, field angle correcting plates 443 and light exit side polarizing plates 444, which are arranged at the rear ends of the respective liquid crystal panels 441R, 441G, and 441B, and a cross dichroic prism 445 which is a color composition optical system.

Figure 8:
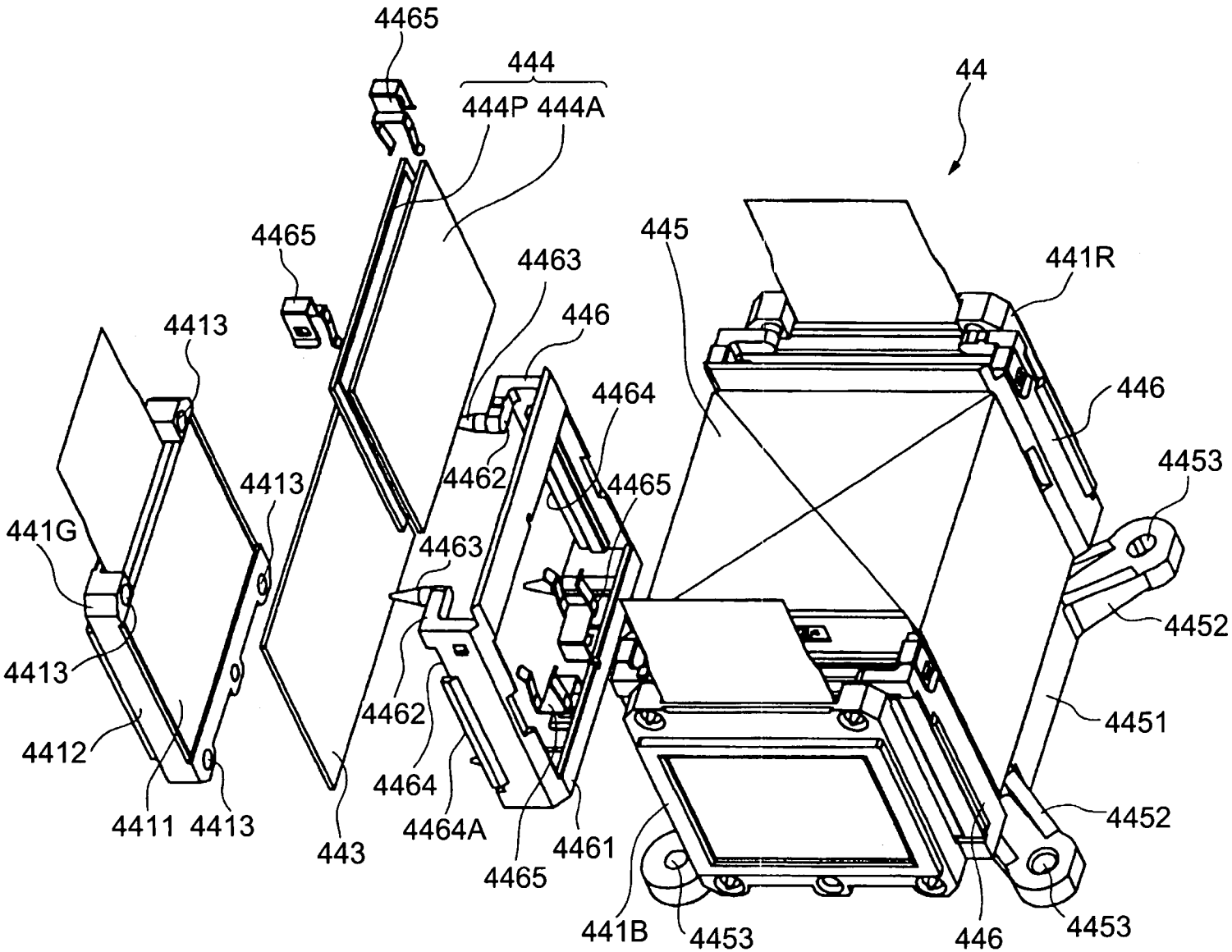
FIG. 8 is a schematic perspective view illustrating a structure of an optical device in accordance with the exemplary embodiment.

The liquid crystal panels 441R, 441G, and 441B includes, for example, polysilicon TFTs as switching devices. As shown in FIG. 8, the liquid crystal panel 441G includes a panel main body 4411 and a supporting member 4412 to receive the panel main body 4411. Furthermore, the liquid crystal panels 441R and 441B is not mentioned because they have the substantially same structure as the liquid crystal panel 441G The panel main body 4411 has a pair of transparent substrates opposite to each other in which liquid crystal is injected and sealed therebetween, and dust-proof glass adheres to the incident and exit sides of the pair of transparent substrates.

The supporting member 4412 has a concave part to receive the panel main body 4411 and also has holes 4413 at its four edges.

The incident side polarizing plates 442 (refer to FIG. 7) arranged at the front ends of the liquid crystal panels 441R, 441G, and 441B transmit only the polarized light in a specific direction of the color light separated by the color separation optical system 42, and absorb the other beams. Furthermore, in the incident side polarizing plate 442, a polarizing film is adhered to a substrate such as sapphire glass. Moreover, instead of the substrate, the polarizing film can be adhered to the field lens 425.

In the field angle correcting plate 443, an optical converting film, which functions to correct the field angle of an optical image formed on the liquid crystal panel 441G is formed on the substrate. Accordingly, the field angle and contrast of the projected image are remarkably enhanced by the field angle correcting plate 443.

The exit side polarizing plate 444 transmits only the polarized light in a specific direction of the beams optically modulated by the liquid crystal panel 441G and absorbs the other beams. In this exemplary embodiment, the exit side polarizing plate 444 includes a first polarizing plate (prepolarizer) 444P and a second polarizing plate (analyzer) 444A. The two exit side polarizing plates 444P and 444A are used to reduce or prevent overheating. That is, the incident polarized light is absorbed separately through the first polarizing plate 444P and the second polarizing plate 444A, and thus heat generated from the polarized light is absorbed separately through the first polarizing plate 444P and the second polarizing plate 444A.

The cross dichroic prism 445 composes optical images modulated in the respective colors of light from the exit side polarizing plates 444 to form color images.

In the cross dichroic prism 445, a dielectric multiple-layer film to reflect red light and a dielectric multiple-layer film to reflect blue light are formed in a substantially X shape along the interface of four right angle prisms to compose three color light.

A prism fixing plate 4451 is adhered to the bottom surface of the cross dichroic prism 445 by an ultraviolet curable adhesive. The prism fixing plate 4451 has edge units 4452 which are extended along the diagonal lines of the cross dichroic prism 445, and holes 4453 are formed at the ends of the edge units 4452.

The optical apparatus 44 is strongly fixed to the horizontal side of the L-shaped head body 403 by inserting screws (not shown) into the holes 4453.

The liquid crystal panel 441G, the field angle correcting plate 443, the first polarizing plate 444P, and the second polarizing plate 444A are fixed to the beam incident surface of the cross dichroic prism 445 through a panel fixing plate 446.

The panel fixing plate 446 includes a fixing unit main body 4461 in substantially C shape in plan view and pins 4463 protruding from the front end of the fixing unit main body 4461 through buffering units 4462. A supporting base 4464, which fixes the field angle correcting plate 443, and a position deciding unit 4464A, which is extended along the circumference of the C-shaped fixing unit main body 4461 and determines the external position of the field angle correcting plate 443, are formed on the circumference of the front end of the C-shaped fixing unit main body 4461.

In order to fix the liquid crystal panel 441G, the field angle correcting plate 443, the first polarizing plate 444P, and the second polarizing plate 444A to the beam incident surface of the cross dichroic prism 445 using the panel fixing plate 446, the first polarizing plate 444P and the second polarizing plate 444A are first inserted into the inside space of the C-shaped fixing unit main body 4461 and then fixed in the space at a predetermined distance from each other by a spring member 4465.

Next, the section of the field angle correcting plate 443 adheres to the supporting base 4464 using a heat conductive tape or adhesive while adjusting the external position of the field angle correcting plate 443 using the position deciding unit 4464A, and then the panel fixing plate 446 is fixed to the beam incident surface of the cross dichroic prism 445.

Then, an ultraviolet curable adhesive is coated on the pins 4463 of the panel fixing plate 446, and in a non-hardening state of the adhesive, the pins 4463 are directly inserted into the holes 4413 of the liquid crystal panel 441G.

In the same order, the liquid crystal panel 441R or 441B is temporarily fixed to the panel fixing plate 446 by the ultraviolet curable adhesive in a non-hardening state of the adhesive, and the red, green and blue light are introduced respectively to the liquid crystal panels 441R, 441G, and 441B. Furthermore, the positions of the liquid crystal panels 441R, 441G, and 441B are adjusted while observing each color of light emitted from the beam exit surface of the cross dichroic prism 445. Thereafter, ultraviolet rays are irradiated to the ultraviolet curable adhesive to decide and fix the positions of the liquid crystal panels 441R, 441G, and 441B after deciding the positions.

(2-2) Structure of Control Substrate 5

As shown in FIGS. 4 and 5, the control substrate 5, which includes a two-layer main substrate 51, is arranged to cover the upper side of the optical unit 4. A control unit main body, such as an operation processing apparatus, is mounted on the upper substrate 511, and the driving ICs of the liquid crystal panels 441R, 441G, and 441B are mounted on the lower substrate 512. Although not illustrated, the control substrate 5 further includes an interface substrate which is connected to the rear end of the main substrate 51 and stands on the case rear surface units 11D and 12D of the armored case 2.

The aforementioned connector group 15 is mounted on the rear surface of the interface substrate, so image information from the connector group 15 can be output to the main substrate 51 through the interface substrate.

The operation processing apparatus on the main substrate 51 processes the input image information and then outputs it to the liquid crystal panel driving IC as a control command. The driving IC generates and outputs driving signals based on the control command to drive the liquid crystal panels 441R, 441G, and 441B. Accordingly, the optical image is formed by optical modulation based on the image information.

(2-3) Structure of Power Block 6

The power block 6, which includes a power unit and a lamp driving unit (not shown), is extended in the projection direction of the armored case 2 of the projector 1 and is adjacent to the optical unit 4.

The power unit supplies external power from a power cable connected to the inlet connector 17 to the lamp driving unit or the control substrate 5.

The lamp driving unit is a conversion circuit to supply power to the light source apparatus 411 described above at a stabilized voltage. The normal alternating current from the power unit is rectified and converted into direct current or square wave alternating current by the lamp driving unit and then is supplied to the light source apparatus 411.

As illustrated in FIG. 3, an exhaust fan 61 is provided at the front side of the power block 6. Therefore, after cooling each constitutional member of the projector 1, air can be collected by the exhaust fan 61 and exhausted through the opening part 28 of the armored case 2.

(2-4) Cooling Structure

Figure 9:
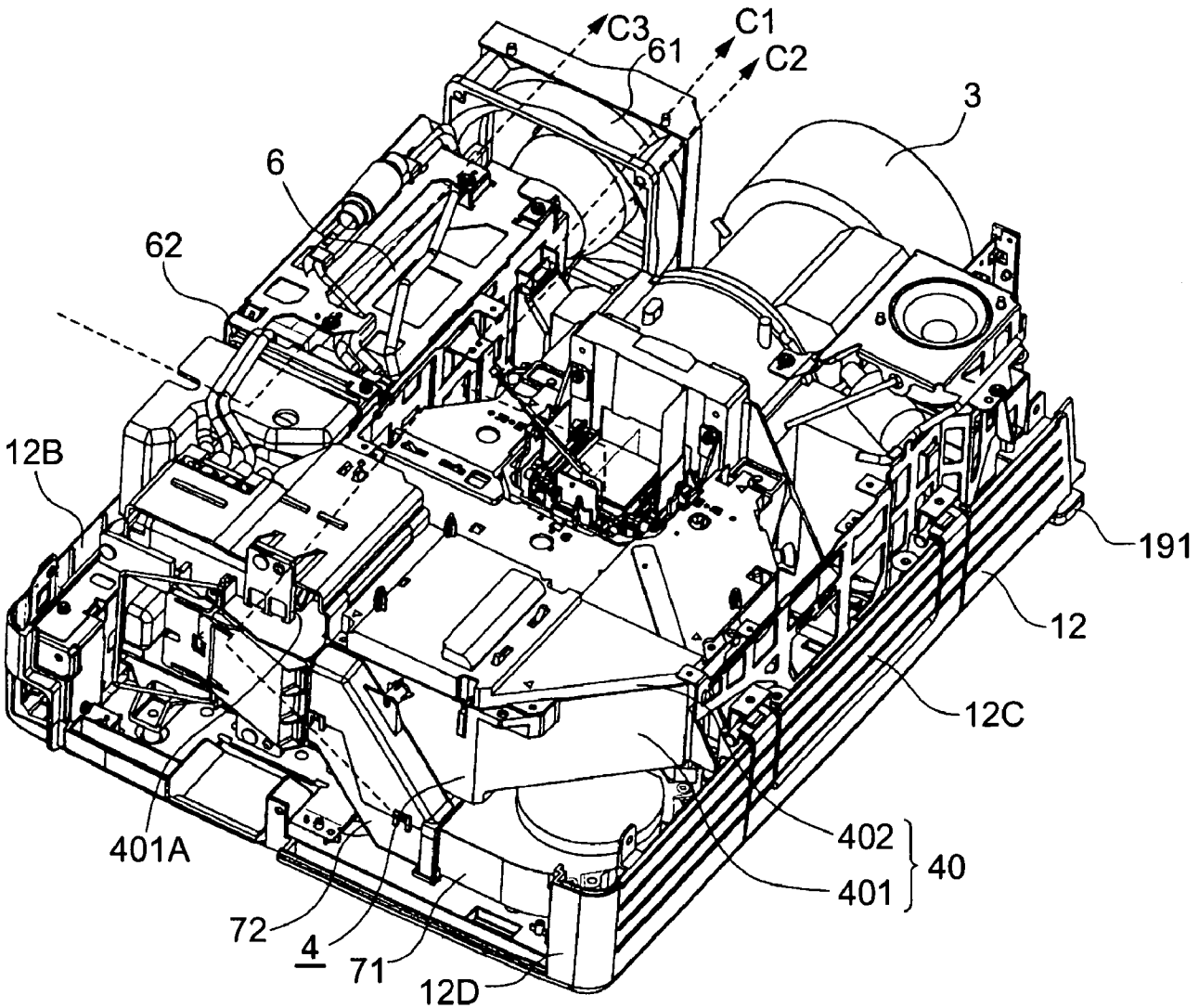
FIG. 9 is a schematic perspective view illustrating a cooling passage in accordance with the exemplary embodiment.

The inside of the projector 1 becomes hot due to heat generated from the light source apparatus 411 or power block 6, and thus it is required to efficiently cool the light source apparatus 411, the optical apparatus 44, and the power block 6 by the inside circulation of cooling air. Accordingly, in this exemplary embodiment, three cooling passages C1, C2 and C3 are provided as shown in FIG. 9.

The cooling passage C1 cools the light source apparatus 411 and the polarization converting device 415 constituting the integrator illumination optical system 41. The cooling passage C1 supplies cool air inhaled through a sirocco fan 71 provided inside the inhalation opening part 24 shown in FIG. 2 from the side of the light source receiving unit 401A of the light guide 40 to the light source apparatus 411 and the polarization converting device 415 through a duct 72 to provide cooling. The waste air after cooling is inhaled by the exhaust fan 61 and then externally exhausted from the projector 1.

The cooling passage C2 cools the optical apparatus 44 to perform optical modulation and color composition. The cooling passage C2 supplies cool air inhaled through the sirocco fan (which is described below) provided inside the inhalation opening part formed in a position, where the filter 23 shown in FIG. 2 is provided, from the lower side to upper side of the optical apparatus 44 to cool the liquid crystal panels 441R, 441G, and 441B, the incident side polarizing plate 442, the field angle correcting plate 443, and the exit side polarizing plate 444. The waste air after cooling flows along the bottom surface of the main substrate 51 and the case upper side unit 11A of the upper case 11 to cool the circuit device mounted on the main substrate 51, and then is exhausted outside by the exhaust fan 61.

The cooling passage C3 cools the power block 6. In the cooling passage C3, cool air is inhaled from the opening part 112, which is provided in the case side unit 11B of the upper case 11, and the opening part 122, which is provided at the case side unit 12B of the lower case 12 by an intake fan 62 provided at the rear end of the power block 6. Some of the cool air is supplied to the power unit and the lamp driving unit and then is exhausted by the exhaust fan 61.

(3) Structure of Lamp Driving Unit

Figure 10:
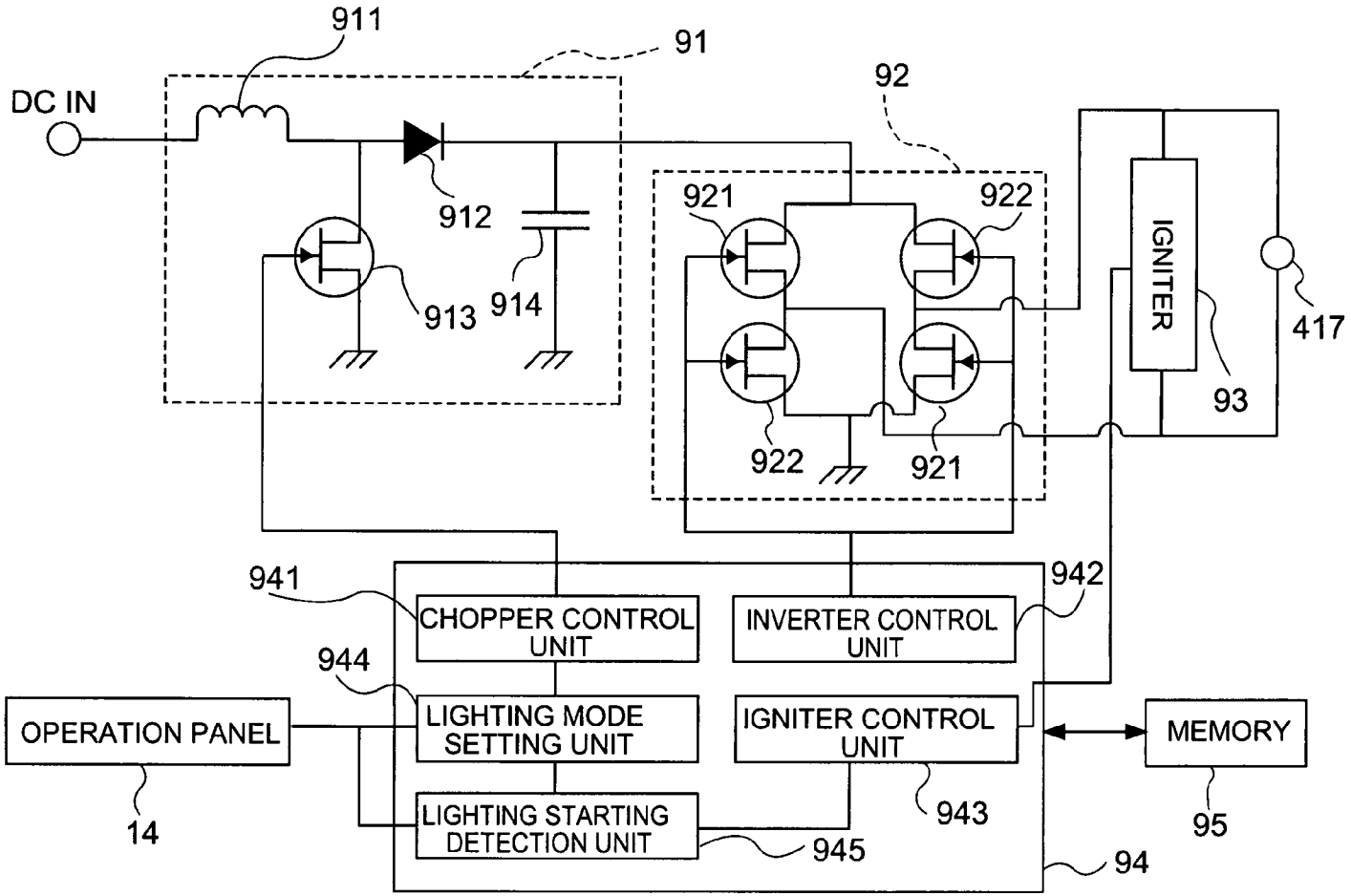
FIG. 10 is a schematic illustrating a structure of a light source driving circuit in accordance with the exemplary embodiment.

As shown in FIG. 10, a lamp driving unit 9, as a light source driving circuit constituting the power supply block 6, is a circuit that converts direct current input from the power unit into alternating square-wave current and turns on the light source lamp 417. The lamp driving circuit 9 includes a down chopper 91, an inverter bridge 92, an igniter 93, a controller 94 as a control device, and a memory 95.

The down chopper 91 is a circuit that lowers an input direct current voltage of about 300 to 400 V to a voltage of 50 to 150 V which is proper to turn on the light source lamp 417. Furthermore, the down chopper 91 includes a coil 911, a diode 912 connected thereto in series, and a transistor 913 and a capacitor 914 branched off from the coil 911 and diode 912.

The coil 911, the diode 912, and the capacitor 914 function to remove a high frequency component from the input direct current or to rectify it. Furthermore, they function to keep the input direct voltage a rated power.

An end of the transistor 913 is connected to the coil 911 and the diode 912, and another end of the transistor is connected to the ground. By using the transistor 913 as a switching element, a part of the input direct current flows to the ground, thereby lowering the voltage. Specifically, the input direct voltage can be lowered to a desired voltage by controlling the switching speed and time constant of the transistor 913.

The inverter bridge 92 converts the direct current into alternating square-wave current and is a bridge circuit that has a pair of transistors 921 and a pair of transistors 922. The light source lamp 417 is connected between the transistors 921 and 922.

When direct current, which is rectified through the down chopper 91, is input to the bridge circuit and then pulse signals are applied to the transistors 921 and 922, a path including a pair of transistors 921 and a path including a pair of transistors 922 are shorted alternately to flow alternating current. Accordingly, the alternating square-wave current flows to the light source lamp 47 connected between the transistors 921 and 922.

The igniter 93 facilitates the starting of the light source lamp 417 by performing the breakdown of the insulation between the electrodes of the light source lamp 417. The igniter 93 is connected to the light source lamp 417 in parallel between a lighting device, which includes the down chopper 91 and the inverter bridge 92, and the light source lamp 417.

In this exemplary embodiment, although it is not shown, the igniter 93 has a high voltage pulse generating circuit and a pulse transformer in which the high voltage pulse generating circuit is connected to its primary coil. Accordingly, the high voltage pulse generated from the high voltage pulse generation circuit is boosted by the secondary coil of the pulse transformer, and the boosted voltage is applied to the light source lamp 417. Thus, the insulation between the electrodes of the light source lamp 417 breaks down, and then an electrical conduction occurs, thereby starting the lighting of the light source lamp 417.

The controller 94 controls the down chopper 91, the inverter bridge 92, and the igniter 93. The controller 94 is composed of a 4-bits microcomputer chip and includes a chopper control unit 941, an inverter control unit 942, an igniter control unit 943, a lighting mode setting unit 944, and a lighting starting detection unit 945, all which are operated by an embedded program.

The chopper control unit 941, as a rated power supplying unit, supplies the rated power or power less than the rated power to the light source lamp 417 by controlling the operation of the down chopper 91, thereby controlling the lighting of the light source lamp. Specifically, the chopper control unit 941 outputs a pulse signal to the transistor 913, which functions as a switching device of the down chopper 91, to control the transistor 913.

The inverter control unit 942 controls the operation of the inverter bridge 92 and outputs the same pulse signal to the transistors 921 and 922 to control the switching of the transistors 921 and 922.

The igniter control unit 943 controls the operation of the igniter 93. When a start operation signal is input to the projector 1, the igniter control unit 943 outputs control signals to the igniter 93 to operate the igniter 93.

The lighting mode setting unit 944 determines whether the light source lamp 417 is lighted by a rated power or a power saving mode. Although a detailed explanation is provided below, when the lighting mode setting unit 944 acquires a lighting mode set by an operator of the projector 1 who operates an operation button on an operation panel 14, it facilitates the chopper control unit 941 to perform the control corresponding to the lighting mode.

A lighting starting detection unit 945 detects whether the illumination of the light source lamp 417 has been started. When the lighting starting detection unit 945 detects illumination, the lighting starting detection unit 945 facilitates the lighting mode setting unit 944 to acquire the set lighting mode and simultaneously facilitates the igniter control unit 943 to control the driving of the igniter 93.

The memory 95 is a memory region which stores each program of the chopper control unit 941, the inverter control unit 942, the igniter control unit 943, the lighting mode setting unit 944, and the lighting starting detection unit 945. These programs are called by a controller 94 after the starting of the projector 1 and then perform each operation.

(4) Lighting Control Method of Light Source Lamp 417

Figure 11:
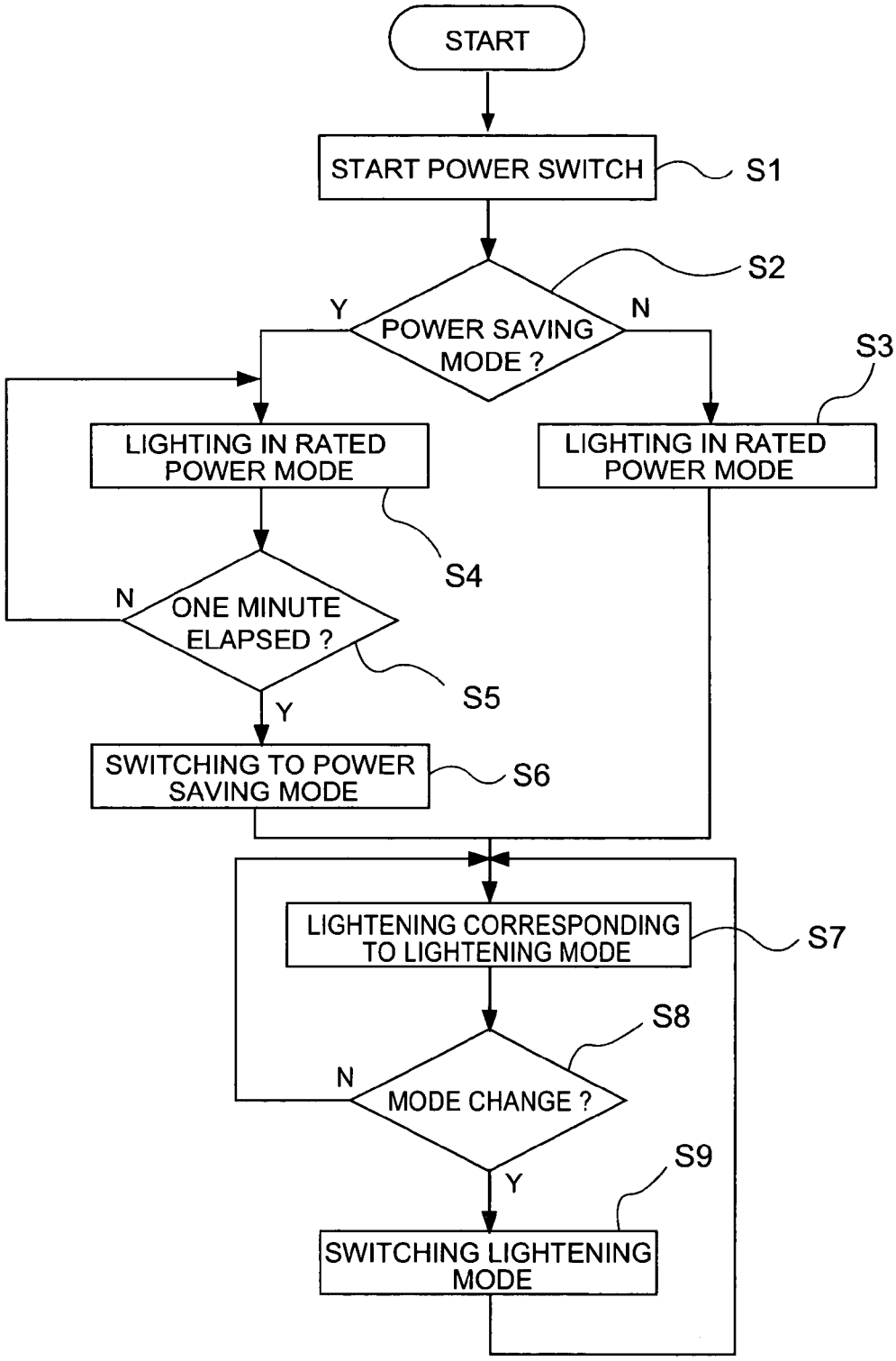
FIG. 11 is a flow chart explaining an operation in accordance with the exemplary embodiment.

The lighting control method of the light source lamp 417 in the aforementioned projector 1 is described below on the basis of a flow chart illustrated in FIG. 11.

(4-1) When a power switch of an operation panel 14 of the projector 1 is pressed by an operator, the chopper control unit 941, the inverter control unit 942, the igniter control unit 943, the lighting mode setting unit 944, and the lighting starting detection unit 945 are called as programs from the memory 95 to controller 94, and a lighting preparation of the light source lamp 417 is performed, so that the lighting starting detection unit 945 detects that the power switch has been started (step S1) and then outputs a control command to the igniter control unit 943. Then, the igniter control unit 943 starts to control the driving of the igniter 93 on the basis of the command.

(4-2) The lighting mode setting unit 944 determines which lighting mode was previously set to the memory 95 (step S2) and then outputs a control command to the chopper control unit 941 in order to perform the lighting control corresponding to the previous lighting mode.

(4-3) When it is determined that the previous lighting mode is the rated power mode, a control command is output to the chopper control unit 941. The chopper control unit 941 performs the driving control to output the rated power to the down chopper 91 (step S3).

Figure 12:
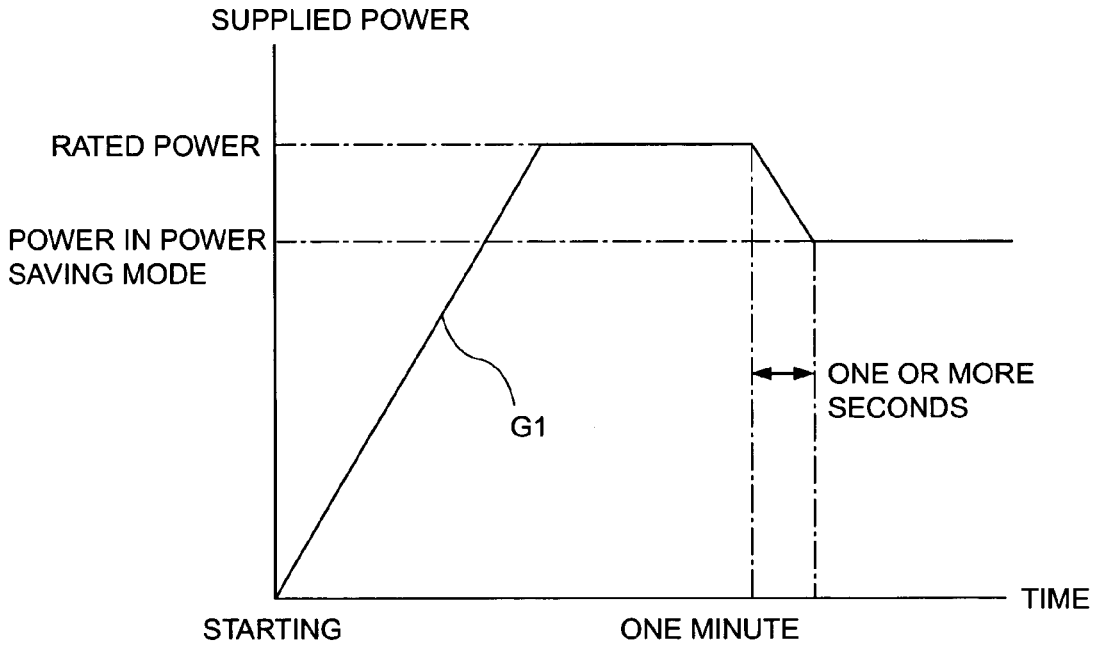
FIG. 12 is a graph illustrating a change of the supplying of power to the light source when starting lighting in accordance with the exemplary embodiment.

(4-4) On the other hand, even if it is determined that the previous lighting mode was the power saving mode, the chopper control unit 941 performs a driving control to output the rated power to the down chopper 91 at the time of starting (step S4). Herein, the supply of power to the light source lamp 417 by the down chopper 91 at the time of starting in the steps S3 and S4 is performed such that the supply of power linearly increases from the starting during a predetermined period of time as shown in graph G1 in FIG. 12.

(4-5) The lighting mode setting unit 944 measures time using a timer circuit mounted to the controller 94 from the starting and determines whether the light source lamp 417 is lighted by the rated power in one minute (step S5). Herein, in the exemplary embodiment, one minute is the time when a halogen cycle of the light source lamp 417 is optimum, and it can be properly changed according to specifications of the light source lamp 417.

(4-6) When the lighting mode setting unit 944 determines that one minute has passed, the lighting mode setting unit 944 outputs a control command to the chopper control unit 941 to light the light source lamp 471 with the power saving mode (step S6). The chopper control unit 941 outputs pulse signals to the transistor 913 of the down chopper 91 on the basis of the control command, and then a part of the direct current input to the down chopper 91 flows to the ground. Thus, power less than the rated power is supplied to the light source lamp 417. In this case, the chopper control unit 941 does not switch the lighting mode to the power saving mode in a moment, and as shown in the right side of graph G1 in FIG. 12, the chopper control unit 941 switches the lighting mode for one or more seconds.

(4-7) The light source lamp 471 is lighted according to the set lighting mode by controlling the down chopper 91 as described above (step S7). At that time, the lighting mode setting unit 944 monitors whether the lighting mode has changed by the operation of the operation panel 14 (step S8).

Figure 13:
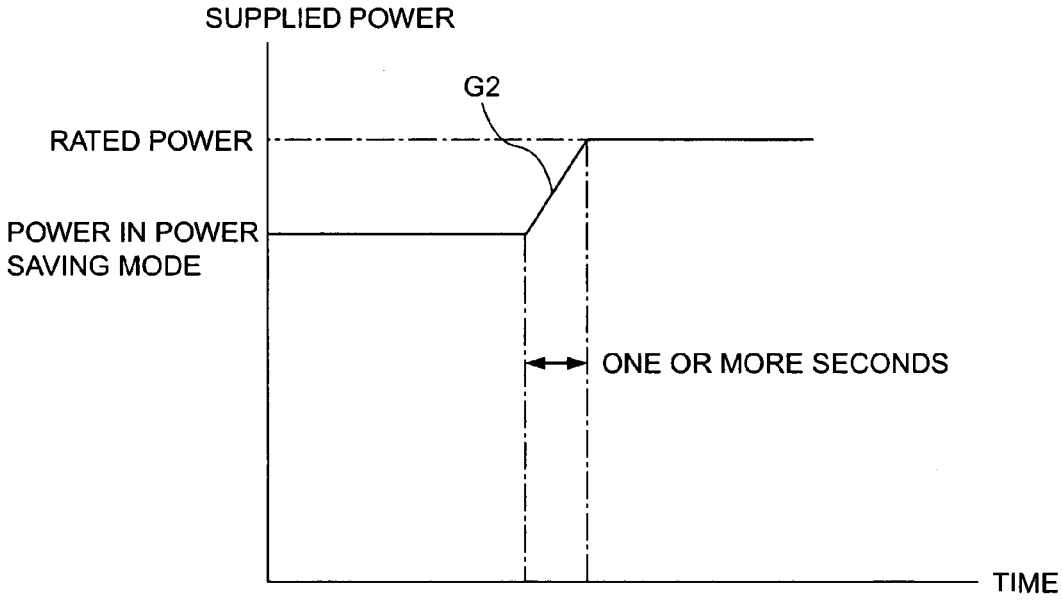
FIG. 13 is a graph illustrating a change of the supply of power when changing a lighting mode in accordance with the exemplary embodiment.
Figure 14:
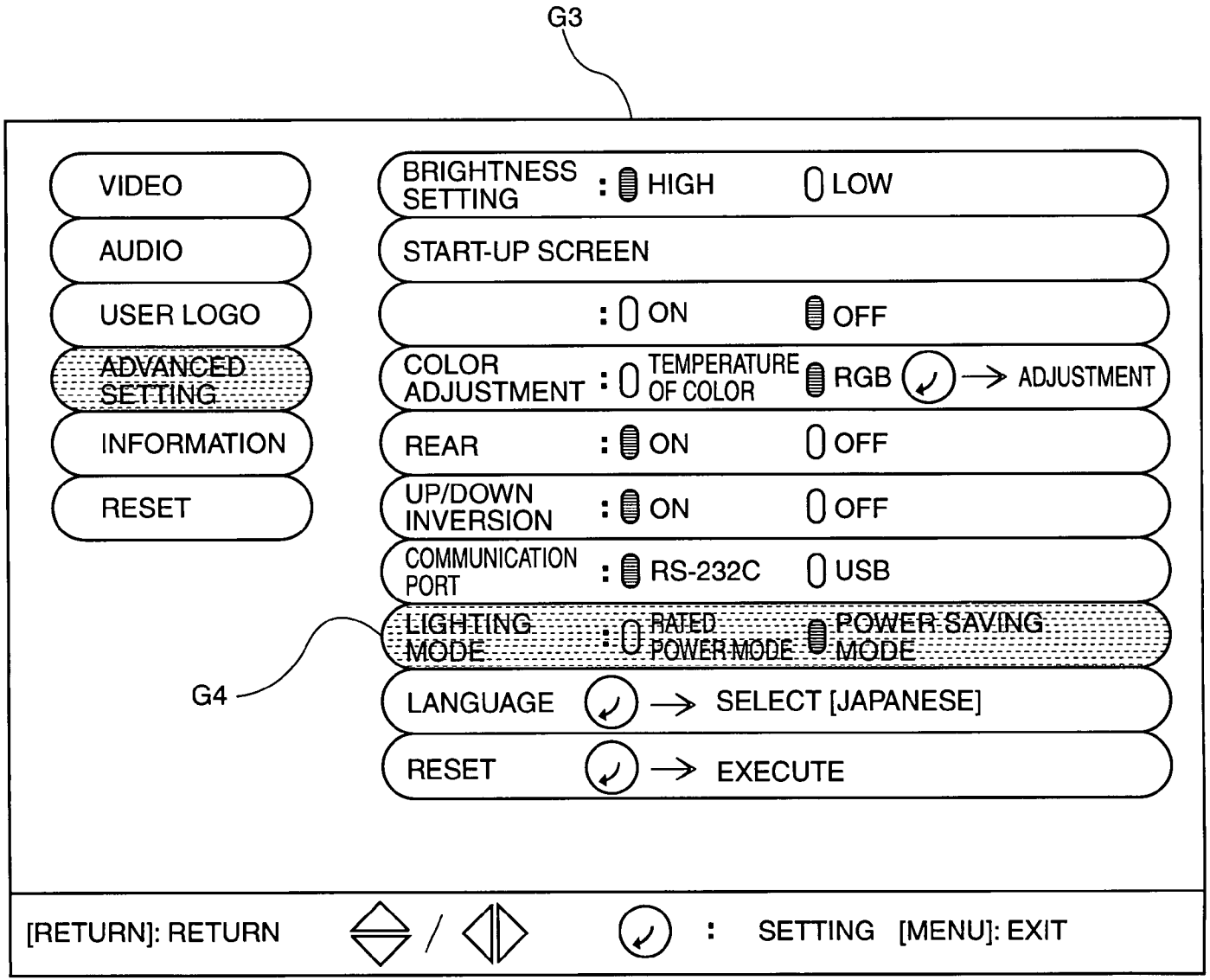
FIG. 14 is a schematic illustrating a lighting mode change screen in accordance with the exemplary embodiment.

(4-8) When the lighting mode setting unit 944 detects the change of the lighting mode, the lighting mode is switched to the changed lighting mode similarly to the above method (step S9). For example, when the power saving mode is switched to the rated power mode, as shown in graph G2 in FIG. 13, the switching from the power saving mode to the rated power mode, which lasts more than one second, is performed. Also, in the change of the lighting mode by the operation of the operation panel 14, when menu buttons provided on the inside of the operation panel 14 are pressed, a menu screen G3 as illustrated in FIG. 14 is displayed on the projected screen. A user can move a cursor to G4 part in the menu screen, can select from the menu, and can change the menu. Also, when the lighting mode is changed during the starting of the projector 1, it is stored in the memory 95 and used at the next starting as the lighting mode.

(5) Exemplary Effects of Exemplary Embodiment

As described above, according to the exemplary embodiments of the present invention, several exemplary advantages are described below.

(5-1) According to the present invention, when starting the lighting of the light source lamp 417, the light source lamp 417 is lighted with the rated power for one second by the chopper control unit 941 as the rated power supplying unit at the lighting time. Thus, the electrodes of the discharge tube are sufficiently heated to obtain an appropriate halogen cycle. Accordingly, even if the light source is switched to the power saving mode, the inside temperature of the discharge tube due to illumination is maintained, and the halogen cycle is maintained. Accordingly, it is possible to turn on the light source lamp 417 with the power saving mode and the rated power mode, and to light the light source lamp 417 at a proper halogen cycle, and thus to increase the life span of the light source lamp 417.

(5-2) Since the switching between the lighting modes is performed for one or more seconds, prominences and depressions of the electrode illumination surfaces of the light source lamp 417 can be reduced or prevented. Thus, flicker in illumination by an arc jump is reduced or prevented, and flicker in the screen of the projector 1 is also reduced or prevented. Furthermore, at that time, since power is linearly changed in switching, the switching between the lighting modes can be performed smoothly.

(5-3) Since the lamp driving unit 9 has an inverter bridge 92, it is possible to convert the input direct current into alternating square-wave current, and then to turn on the light source lamp 417. Thus, it is possible to use an alternating current driving type light source lamp 417, and thus to obtain a light source lamp capable of illuminating lightly in comparison with the direct current type light source.

(5-4) The chopper control unit 941, the inverter control unit 942, the igniter control unit 943, the lighting mode setting unit 944, and the lighting starting detection unit 945 are constructed as programs which are operated in a controller 94. Even if the structures of the down chopper 91, the inverter bridge 92, and the igniter 93 are changed, a user can cope with the change only by modifying and changing the programs. Furthermore, when controlling them, it is not necessary to significantly change the structures.

(5-5) Thus, the increase of the inside temperature of the projector 1 is reduced or minimized by lighting the light source lamp 417 of the projector 1 in the power saving mode. Thus, the number of revolutions of fans 61, 62, and 71 can be reduced during the operation, and thus a silent or substantially silent projector 1 can be enhanced. Accordingly, the projector of the present invention is suitable for a home theater system.

(6) Exemplary Modifications of Exemplary Embodiment

Furthermore, the present invention is not limited to the above exemplary embodiments and includes exemplary modifications described hereinafter.

Figure 15:
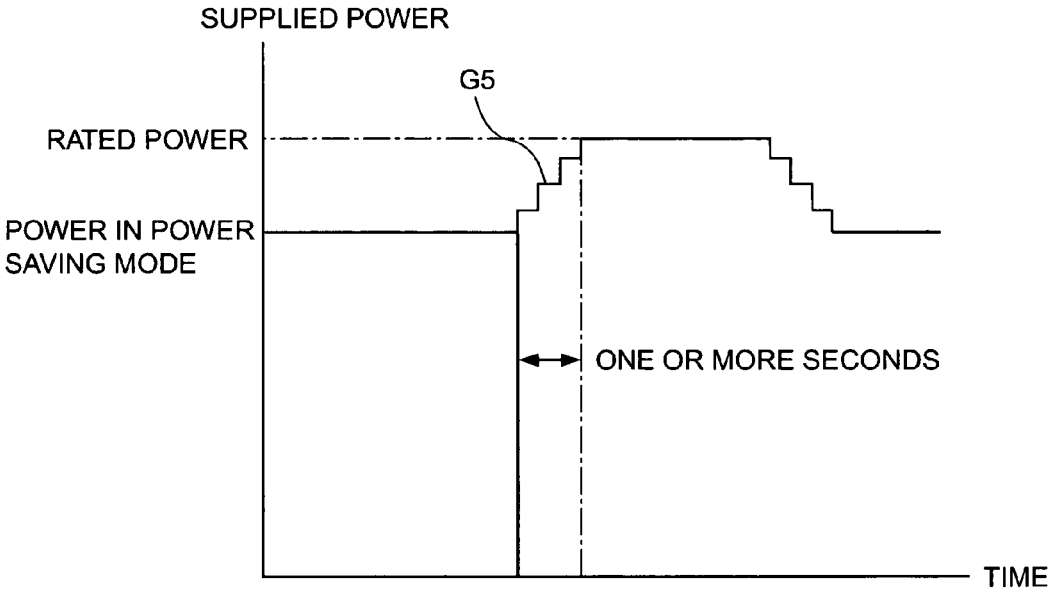
FIG. 15 is a graph illustrating a change of the supply of power in an exemplary modification of the exemplary embodiment.
Figure 16:
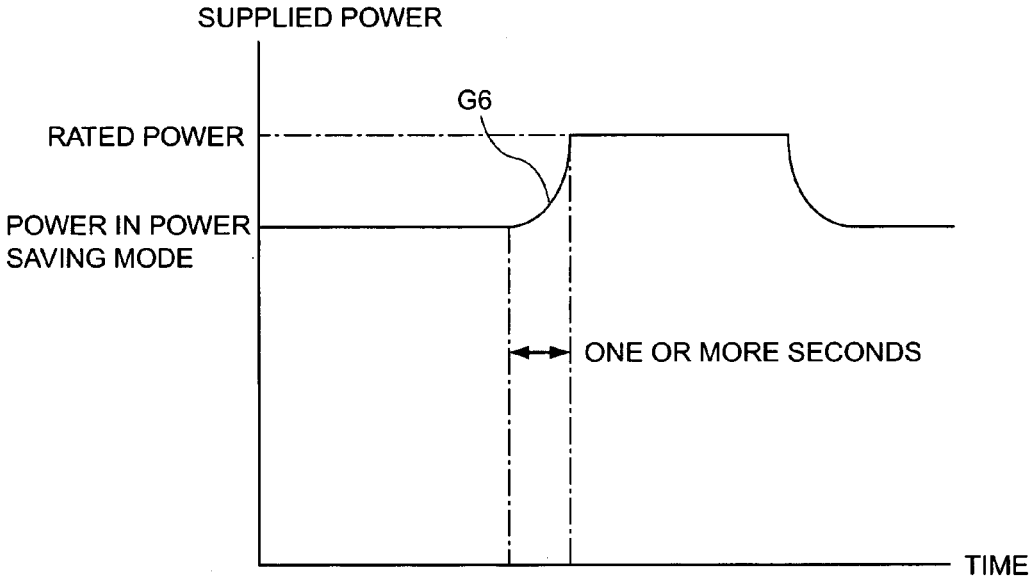
FIG. 16 is a graph illustrating a change of the supply of power in another exemplary modification of the exemplary embodiment.

According to the above exemplary embodiments, the switching between the power saving mode and the rated power mode is linearly changed for one or more seconds. However, the present invention is not limited thereto. That is, as shown in graph G5 in FIG. 15, a switching method, where the switching between the lighting modes is performed slowly and gradually, may be used. Furthermore, as shown in graph G6 in FIG. 6, a switching method, where the switching between the lighting modes is performed in a curvilinear fashion, may be used. These switching methods can be changed by properly setting pulse widths, pulse periods, and pulse amplitudes of the pulse signals output from the chopper control unit 941. The switching method as illustrate in graph G5, in which the lighting mode is digitally switched, is very useful for the control by a microcomputer.

Furthermore, in the above exemplary embodiment, although the lighting mode includes only two stages of the rated power mode and the power saving mode, the present invention is not limited thereto. That is, even if a plurality of power saving modes are included, the present invention can be used, and can achieve the same operation and effects as the above-described operation and effects.

Moreover, in the above exemplary embodiment, although liquid crystal panels 441R, 441G, and 441B are used as a light modulation device, the present invention is not limited thereto. That is, the present invention may be used for a projector having a light modulation device using a micromirror and a light modulation device using another modulation method.

In addition, in the exemplary embodiments, although a light source driving circuit according to the present invention is used for the projector 1, the present invention is not limited thereto. For example, if an apparatus has a light source which is composed of a discharge tube, the apparatus can be provided with the present invention and can provide the above-described operation and effects.

Furthermore, in the above exemplary embodiments, although various control unit including the chopper control unit 941 and the lighting mode setting unit 944 are composed of programs which are provided to the inside of the controller 94, the present invention is not limited thereto. For example, various circuit devices may be mounted onto a printed circuit board.

In addition to the structures and configurations according to the exemplary embodiments of the present invention, other constructions may be considered within the scope of the present invention.

What is claimed is:

1. A circuit to drive a light source that includes a discharge tube, the circuit comprising:

a control device to drive the light source and to switch the light source to a plurality of lighting modes including a rated power mode and a power saving mode, the control device including:

a lighting mode setting unit to set the lighting mode to one of the plurality of lighting modes; and a rated power supplying unit to supply a rated power to the light source at a lighting starting time of the light source until a halogen cycle of the discharge tube is stabilized, and the control device switches the light source to the lighting mode set by the lighting mode setting unit after the halogen cycle of the discharge tube is stabilized, the switching between the plurality of lighting modes being performed for one or more seconds.

2. The circuit for driving the light source according to claim 1, the switching between the lighting modes being performed by gradually changing the power.

3. The circuit for driving the light source according to claim 1, the switching between the lighting modes being performed by linearly changing the power in switching.

4. The circuit for driving the light source according to claim 1, the switching between the lighting modes being performed by changing a rate of change of power with respect to time in a curvilinear fashion.

5. The circuit for driving the light source according to claim 1, the circuit further including an inverter bridge to convert input direct current into alternating current.

6. A projector to modulate light beams emitted from a light source according to image information to form optical images, and to enlarge and protect the optical images, the projector comprising:

a circuit to drive a light source that includes a discharge tube, the circuit including:

a control device to drive the light source and to switch the light source to a plurality of lighting modes including a rated power mode and a power saving mode, the control device including:

a lighting mode setting unit to set the lighting mode to one of the plurality of lighting modes; and a rated power supplying unit to supply a rated power to the light source at a lighting starting time of the light source until a halogen cycle of the discharge tube is stabilized, and the control device switches the light source to the lighting mode set by the lighting mode setting unit after the halogen cycle of the discharge tube is stabilized the switching between the plurality of lighting modes being performed for one or more seconds.

7. A method of controlling the lighting of a light source, which is executed in a circuit to drive the light source that includes a discharge tube, the circuit including a control device to drive the light source and to switch the light source to a plurality of lighting modes including a rated power mode and a power saving mode, the method comprising:

setting the lighting mode to one of the plurality of lighting modes;

supplying a rated power to the light source a lighting starting time of the light source until a halogen cycle of the discharge tube is stabilized; and switching the light source to the lighting mode set in the setting of the lighting mode after the halogen cycle of the discharge tube is stabilized, the switching between the plurality of lighting modes being performed for one or more seconds.

8. A computer readable program for executing a method of controlling the lighting of a light source, the method being executed in a circuit to drive the light source that includes a discharge tube, the circuit including a control device to drive the light source and to switch the light source to a plurality of lighting modes including a rated power mode and a power saving mode, the program comprising:

a program for setting a lighting starting mode to one of the plurality of lighting modes;

a program for supplying a rated power to the light source at the lighting time of the light source until a halogen cycle of the discharge tube is stabilized; and a program for switching the light source to the lighting mode set in the setting of the lighting mode after the halogen cycle of the discharge tube is stabilized, the switching between the plurality of lighting modes being performed for one or more seconds.

* * * * *